US005300938A

United States Patent [19]

Maroun et al.

[11] Patent Number: 5,300,938

[45] Date of Patent: Apr. 5, 1994

[54] ANTENNA SYSTEM FOR A DATA COMMUNICATION RECEIVER

[75] Inventors: Tony Y. Maroun, Boynton Beach; William R. Van Dyke, Jr., Lighthouse Point; Gregory W. Fuller, Boca Raton, all of Fla.

[73] Assignee: Motorola, Inc., Schaumburg, Ill.

[21] Appl. No.: 986,314

[22] Filed: Dec. 7, 1992

[51] Int. Cl.[5] ..... H01Q 1/24

[52] U.S. Cl. ..... 343/702; 343/742; 343/842

[58] Field of Search ..... 343/702, 728, 741, 742, 343/745, 841, 842; 455/269, 274, 90, 347, 289; H01Q 1/24, 1/52

[56] References Cited

U.S. PATENT DOCUMENTS

| | | | |
|---|---|---|---|
| 4,155,091 | 5/1979 | Vorie | 343/728 |
| 4,814,782 | 3/1989 | Chai | 343/787 |
| 4,862,181 | 8/1989 | Ponce de Leon et al. | 343/702 |
| 5,043,721 | 8/1991 | May | 340/825.44 |
| 5,048,118 | 9/1991 | Brooks et al. | 455/344 |
| 5,050,236 | 9/1991 | Colman et al. | 343/748 |

FOREIGN PATENT DOCUMENTS

| | | | |
|---|---|---|---|
| 0228826 | 9/1990 | Japan | 455/274 |
| 655205A5 | 3/1986 | Switzerland . | |

OTHER PUBLICATIONS

NewsStream TM "Information on the Move" Color Brochure RC-5-49, Motorola, Inc.

NewsStream TM "Information on the Move" Catalog Sheet R3-5-165, Motorola, Inc.

*Primary Examiner*—Donald Hajec

*Assistant Examiner*—Tan Ho

*Attorney, Agent, or Firm*—Philip P. Macnak; Thomas G. Berry; Daniel R. Collopy

[57] ABSTRACT

An antenna system for a communication receiver (100) which has an internal antenna (200) and which is coupled to a portable computer (104) to deliver received data messages thereto comprises a resonant loop antenna (16) magnetically coupled to the internal antenna (200) of the communication receiver (100), and a resonant wireframe shield (18, 40) which is coupled to the resonant loop antenna (16) and oriented perpendicular thereto. The resonant wireframe shield (18, 40) shields the communication receiver (100) from an electrical interference signal generated by the portable computer (104).

19 Claims, 5 Drawing Sheets

ANTENNA SYSTEM FOR A DATA COMMUNICATION RECEIVER

BACKGROUND OF THE INVENTION

1. Field of the Invention

The present invention relates generally to the field of antennas, and more particularly to an antenna system for a data communication receiver.

2. Description of the Prior Art

Portable data communication receivers have recently become available which enable the reception of data messages which can be downloaded to a personal computing device. An example of one such a portable data communication receiver is the NewStream TM Advanced Information Receiver manufactured by Motorola Inc. which can be coupled to a portable computer such as the HP 95LX palmtop computer manufactured by Hewlett Packard. Because of the relatively small size of the palmtop computer when coupled to the data communication receiver, the computer/data receiver pair can be easily carried about by the user, can be conveniently set on a desk top to enable independent use of the palmtop computer to run programs stored in an internal memory, or to enable the user to review information received by the data communication receiver. Because of the flexibility imparted by the small size of the computer/data receiver pair with regards to location, there are times when the data communication receiver can be inadvertently positioned by the user in a location where the data signal transmission signal strength is greatly diminished, such as being placed in a signal null, or placed in an area essentially shielded from the data signal transmissions.

Numerous prior art portable communication receivers were equipped with collapsible whip antennas, or provided with an external antenna input which allowed coupling the receiver to an external receiving antenna, both of which greatly reduced receiver sensitivity degradation due to placement of the receiver. While somewhat effective, collapsible whip antennas are generally unsightly, and placement of the external antenna to hide the cables from view was next to impossible. Portability was further compromised with those receivers which provided an external antenna input.

Significant sensitivity degradation can also be encountered when a portable computer is coupled to the data communication receiver at certain receiver operating frequencies, which albeit can be remedied by turning off the portable computer, does not satisfy the need to receive information while additional data is being received by the data communication receiver.

There is a therefor a need for an antenna system which minimizes the signal degradation due to placement of the computer/data receiver pair as described above. Furthermore, there is a need for an antenna system which can enhance the sensitivity of the data communication receiver, and which is readily removable when use is not required, and which is aesthetically pleasing when coupled to the portable computer/data communication receiver pair.

SUMMARY OF THE INVENTION

In accordance with one aspect of the present invention, supplementary antenna system for a communication receiver which has an internal antenna and which is coupled to a portable computer to deliver received data messages thereto, comprises a resonant loop antenna magnetically coupled to the internal antenna of the communication receiver, and a resonant wireframe shield, coupled to the resonant loop antenna and oriented perpendicular thereto, for shielding the communication receiver from an electrical interference signal generated by the portable computer.

In accordance with another aspect of the present invention, a supplementary antenna system for a wireless computing system, comprises a communication receiver, having an internal antenna, for receiving transmitted data messages, a portable computer, coupled to the communication receiver, for receiving and processing the data messages received by the communication receiver, a resonant loop antenna magnetically coupled to the internal antenna of the communication receiver, and a resonant wireframe shield, coupled to the resonant loop antenna and oriented perpendicular thereto, for shielding the communication receiver from an electrical interference signal generated by the portable computer.

In accordance with yet another aspect of the present invention, a supplementary antenna system for a wireless computing system, comprises a communication receiver, having an internal antenna mounted on a printed circuit board supporting a receiver circuit, the internal antenna having a major axis corresponding to the magnetic field of a transmitted electromagnetic wave, for receiving data messages transmitted on said electromagnetic wave, a portable computer, coupled to the communication receiver, for receiving and processing the data messages received by the communication receiver, a cradle for securing positionally the communication receiver and the portable computer, and a supplementary antenna. The supplementary antenna comprises a resonant loop antenna magnetically coupled the internal antenna of the communication receiver, and a resonant wireframe shield, coupled to the resonant loop antenna and oriented perpendicular thereto, for shielding the communication receiver from an electrical interference signal generated by the portable computer. A housing encloses the resonant loop antenna and the resonant wireframe shield, and further positions the resonant loop antenna in a plane perpendicular to the major axis of the internal antenna, and further positions the resonant wireframe shield parallel to the printed circuit board.

DESCRIPTION OF THE PREFERRED EMBODIMENTS

Figure 1:
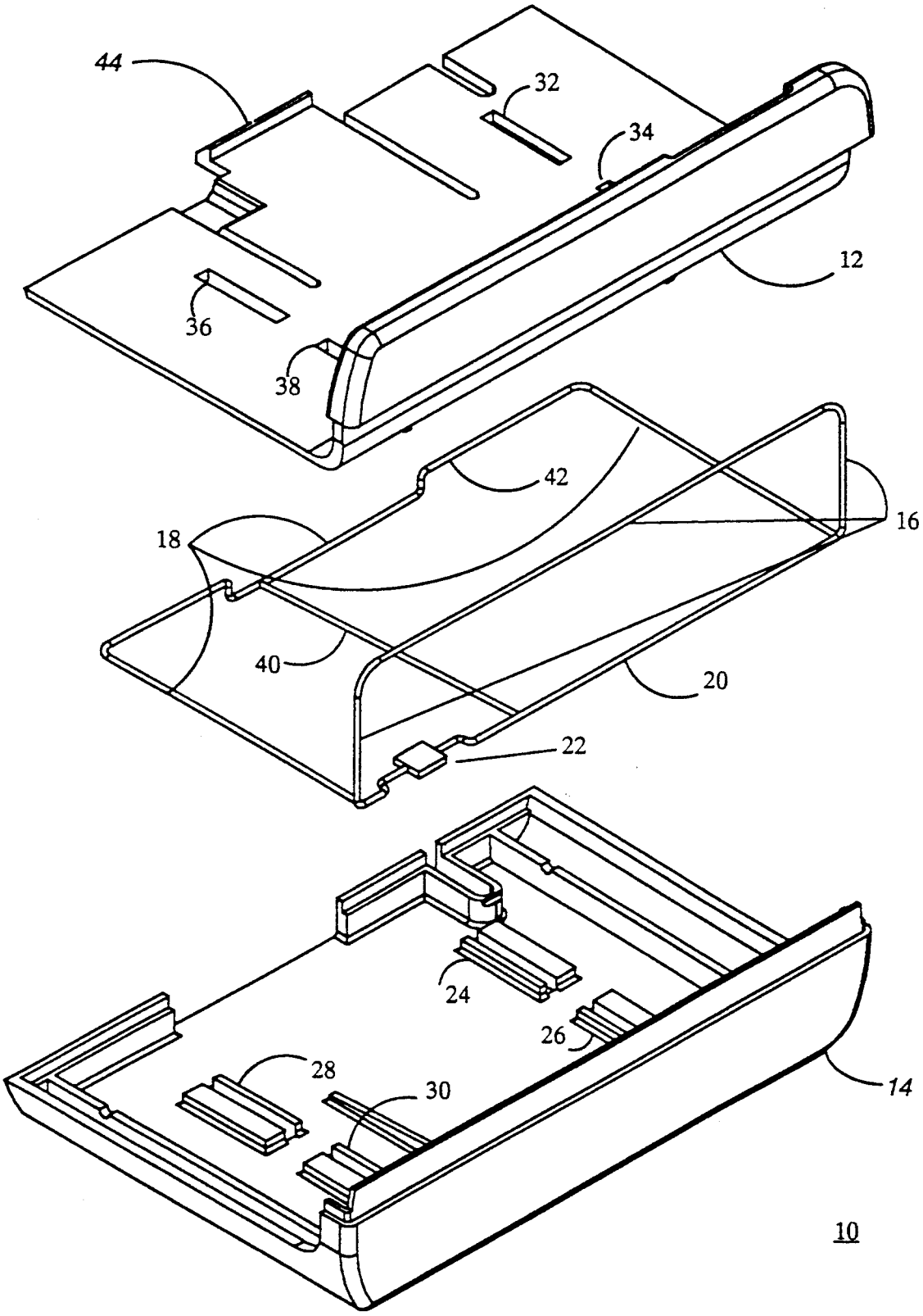
FIG. 1 is an isometric exploded view Of a supplementary antenna in accordance with the preferred embodiment of the present invention.

FIG. 1 is an isometric exploded view of a supplementary antenna 10 in accordance with the preferred embodiment of the present invention. As shown in FIG. 1, the supplementary antenna 10 comprises a housing which includes an upper housing portion 12 and a lower housing portion 14 which is used to enclose an antenna which includes a resonant loop antenna 16 and a resonant wireframe shield 18. The resonant wireframe shield 18 is coupled to the resonant loop antenna 16 and oriented in a plane perpendicular to the plane of the resonant loop antenna 16. The upper and lower housing portions 12, 14 are manufactured preferably using injection molding techniques which are well known in the art, using a plastic material such as a polycarbonate plastic. It will be appreciated that other plastic materials can be utilized as well. Latching features 24, 26 28 and 30 are molded into the bottom housing portion 14 and interlock with mating features 32, 34, 36 and 38 molded into the top housing portion 12 to secure the resonant loop antenna 16 and resonant wireframe shield 18 within the housing. Also included on the top housing portion 12 is a molded latch 44 which engages with a mating feature in a cradle, thereby locking the supplementary antenna 10 is position, as will be described below.

As shown in FIG. 1, the resonant loop antenna 16 has a common side 20 to which a tuning element 22, such as a variable trimmer capacitor, is coupled in series with the loop to tune the resonant loop antenna 16 to the receiver operating frequency, such as an operating frequency within a range of from 150–170 Megahertz (MHz). A shorting element 40 is attached to and perpendicular to the common side 20 and a side 42 of the resonant wireframe shield 18 which is parallel to and opposed to the commonside 20. The shorting element 40 optimizes the coupling between the resonant loop antenna 16 and the data communication receiver antenna, to be described below. The resonant wireframe shield 18 and the shorting element 40 are attached to the common side 20 of the resonant loop antenna 16 using such joining techniques as spot welding. The resonant loop antenna 16, the resonant wireframe shield 18 and the shorting element 40 are preferably formed from a wire such as 0.028 inch (0.7 mm) diameter stainless steel wire, although it will be appreciated that beryllium copper or copper can be utilized as well. The wire is suitably heat treated to maintain the shape during handling, and is plated using a suitable plating, such as tin which improves the wire conductivity and insures solderability of the tuning element 22. The resonant loop antenna 16 is approximately 3.1 inches (7.9 cm) by 0.75 inches (19 mm) and the resonant wireform shield 18 is approximately 3.1 inches (7.9 cm) by 1.7 inches (4.3 cm). When the resonant loop antenna 16 is tuned using the tuning element 22, the resonant wireform shield 18 is also resonated in a manner which rejects electrical interference generated by a portable computer as will be described below.

Figure 2:
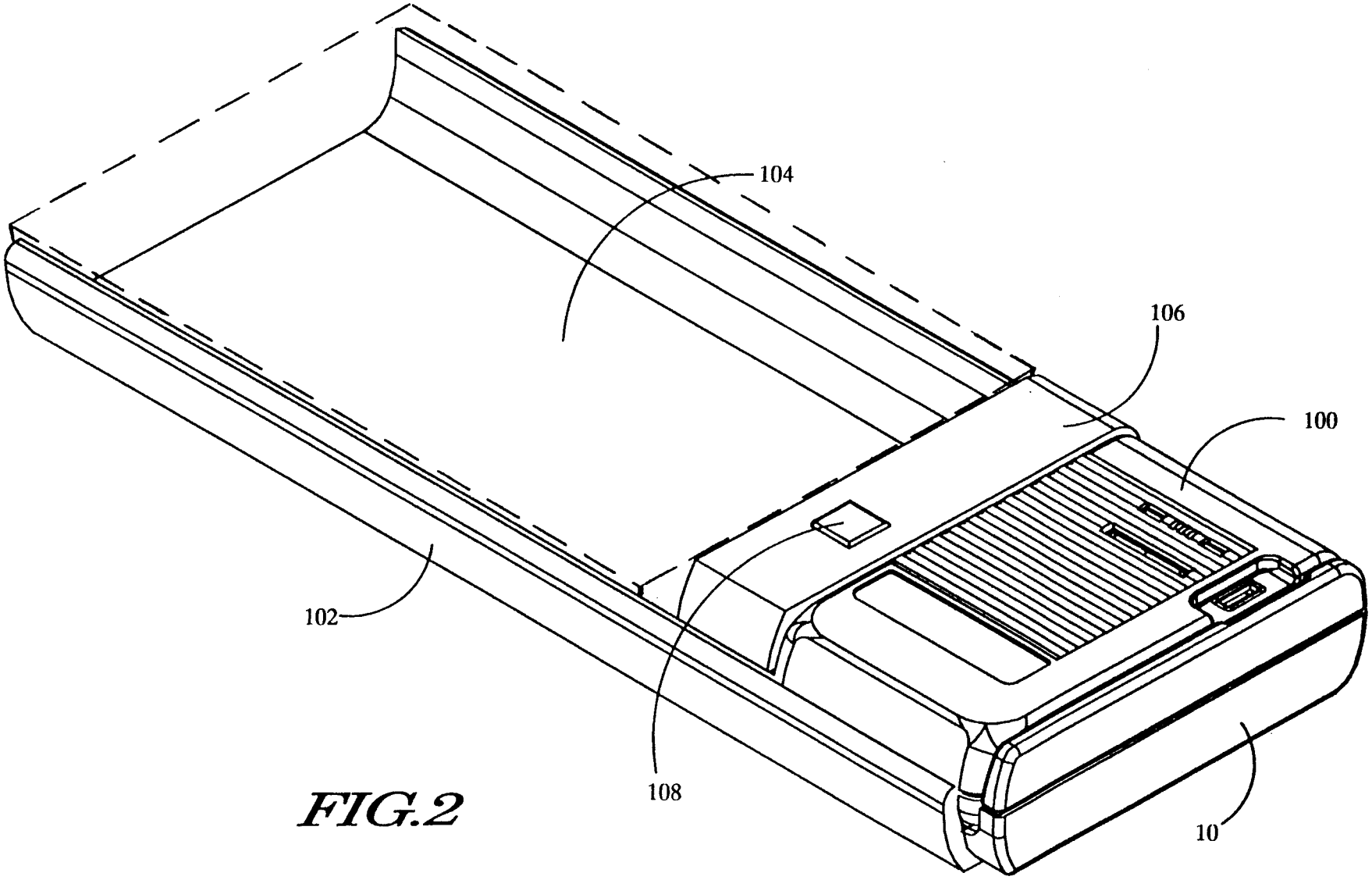
FIG. 2 is an isometric view of a supplementary antenna system in accordance with the preferred embodiment of the present invention.

FIG. 2 is an isometric view of the supplementary antenna 10 which is coupled to a communication receiver 100 in a cradle 102 in accordance with the preferred embodiment of the present invention. A portable computer 104 (not shown), such as a Hewlett Packard 95LX laptop computer, is coupled to the communication receiver 100, and receives and processes data downloaded from the communication receiver 100. The cradle 102 includes a partition 106 which separates the communication receiver 100 from the portable computer 104. When the supplementary antenna 10 is coupled to the cradle 102, the molded latch feature 44 shown in FIG. 1 engages with a corresponding latching feature located in the partition 106. A button 108 is used to release the molded latch 42 releasing the supplementary antenna 10 from the cradle 102, and also releases the communication receiver 100 from the cradle 102.

Figure 3:
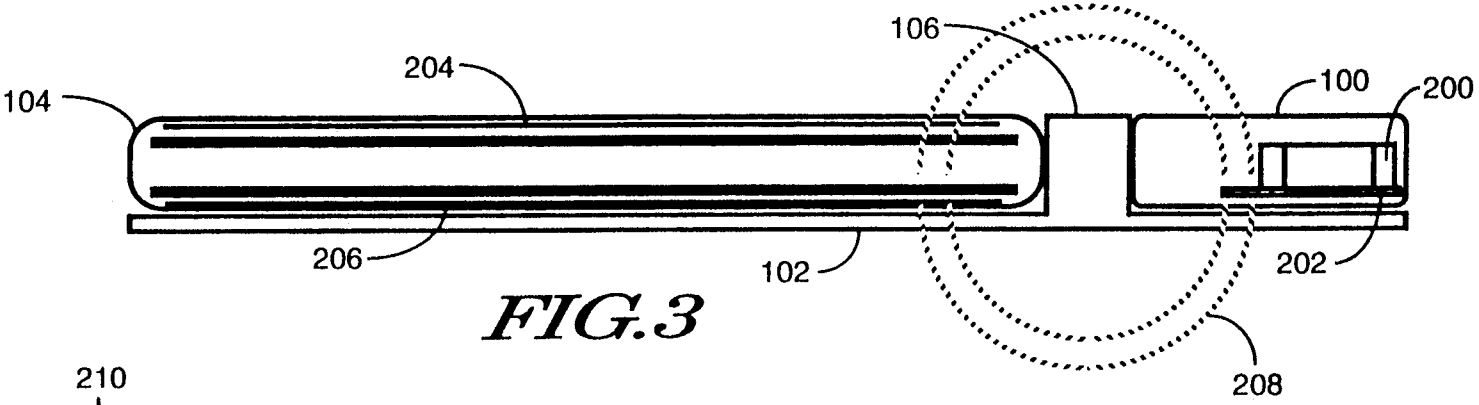
FIGS. 3 and 4 are electro-mechanical diagrams illustrating the electrical interference which is encountered when the communication receiver is coupled to a portable computer.
Figure 4:
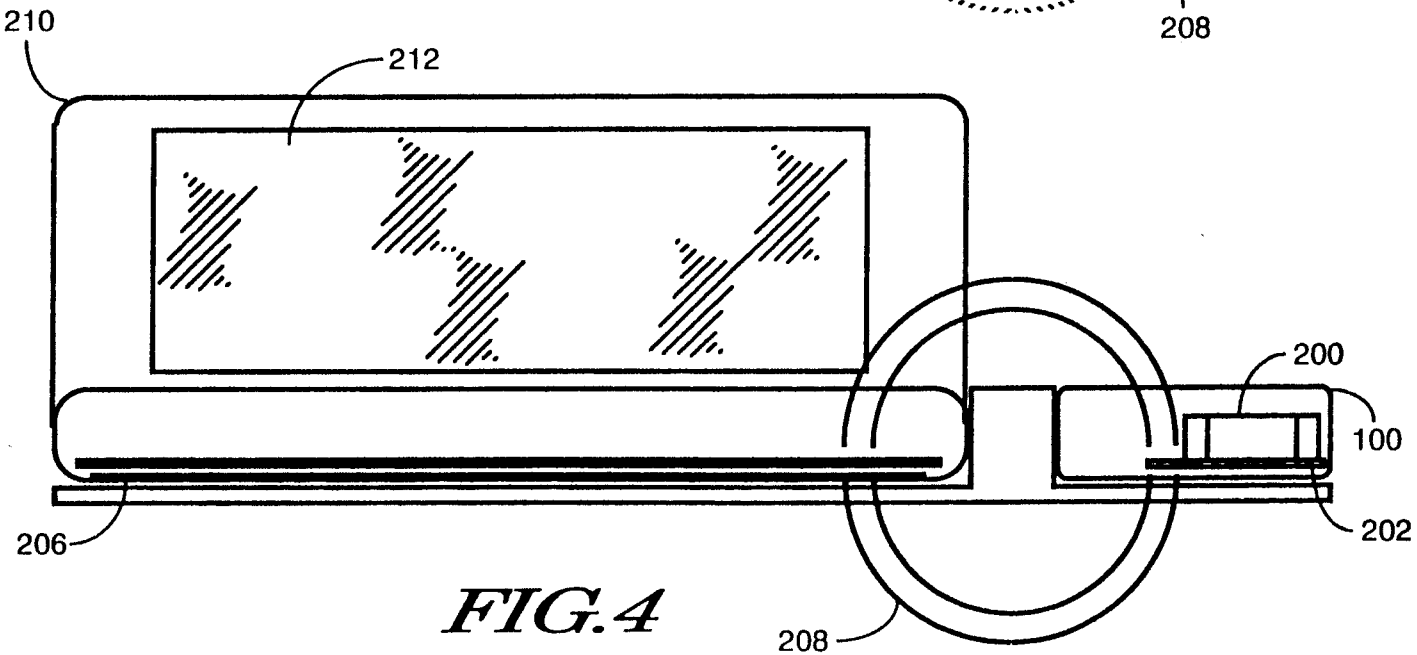

FIGS. 3 and 4 are electro-mechanical diagrams illustrating the electrical interference which is encountered when the communication receiver 100 is coupled to a portable computer 104. As shown in FIG. 3, the communication receiver 100 is held in the cradle 102 and is coupled to the portable computer 104 through a connector within the cradle partition 106. Located within the communication receiver housing is a printed circuit board 202 which supports the receiver circuitry and an antenna 200. Such an antenna is described in U.S. Pat. No. 4,814,782 issued Mar. 21, 1989 to Chai, entitled "Single Turn Ferrite Rod Antenna and Method" which is assigned to the assignee of the present invention, and which is incorporated by reference herein. When the portable computer 104 is closed, as depicted in FIG. 3, most interfering signals 208 generated by the portable computer are effectively contained by shielding comprising metal plates 204 and 206. However, when a lid 210 of the portable computer 104 is opened exposing a display 212 and keyboard (not shown) the interfering signals 208 which were contained by the metal plates 204 and 206, are no longer contained which can result in desensitization of the communication receiver 100. The supplementary antenna 10, when coupled to the communication receiver 100, significantly reduces the desensitization, as will be describe below.

Figure 5:
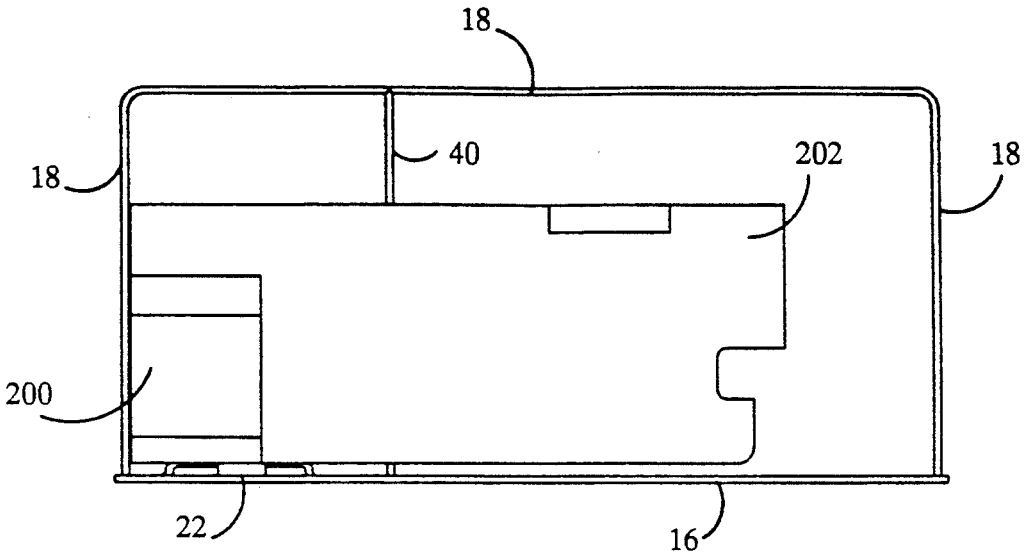
FIGS. 5 and 6 are mechanical diagrams illustrating the placement of the supplementary antenna in accordance with the preferred embodiment of the present invention.
Figure 6:
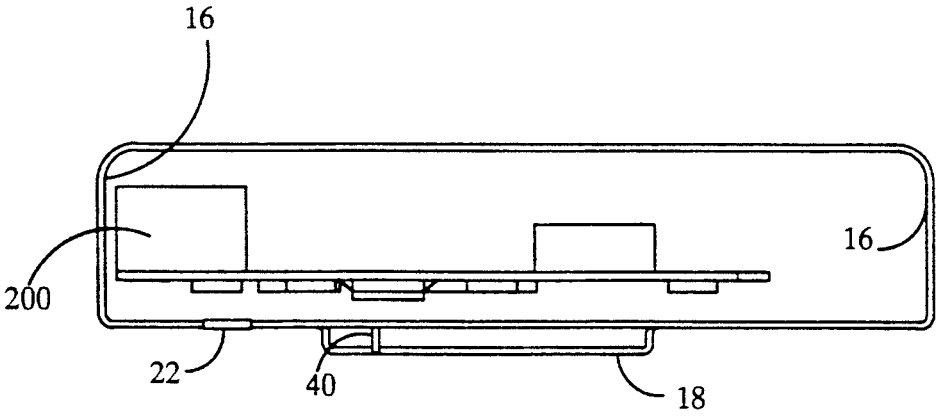

FIGS. 5 and 6 are mechanical diagrams illustrating the placement of the supplementary antenna 10 in accordance with the preferred embodiment of the present invention. As shown in FIGS. 5 and 6, the supplementary antenna 10 when engaged in the cradle 102 positions the resonant loop antenna 16 to provide electromagnetic coupling with the ferrite antenna 200. Also, when engaged in the cradle 102, the resonant wireframe shield 18 surrounds the receiver printed circuit board 202. When the resonant loop antenna 16 and the resonant wireframe shield 18 are tuned by tuning element 22 to the operating frequency, the received signal strength is enhanced by the resonant loop antenna 16, and the computer generated interference is attenuated by the resonant wireframe shield 18. The shorting element 40 crosses under the receiver printed circuit board 202 and is positioned in the relative proximity of the ferrite antenna and enhances the coupling of the signal interrupted by resonant loop antenna 16 and antenna 200. The table below indicates the level of interfering signal reduction achieved with the supplementary antenna 10 in accordance with the present invention.

| Test Condition | Receiver Sensitivity |
|---|---|
| Receiver alone (free field) | Ref. (dBm) |
| Receiver with Supplementary Antenna/Computer Off | +3 (dBm) |
| Computer on/no Supplementary Antenna | −16 (dBm) |
| Computer on/with Supplementary | −2 (dBm) |

As can be seen from the table above, significant degradation in receiver sensitivity can be encountered when the portable computer is turned on and the lid is opened. Most of the receiver sensitivity degradation caused by the computer generated interference is recovered when the resonant loop antenna and resonant wireform shield are tuned to the receiver operating frequency.

Figure 7:
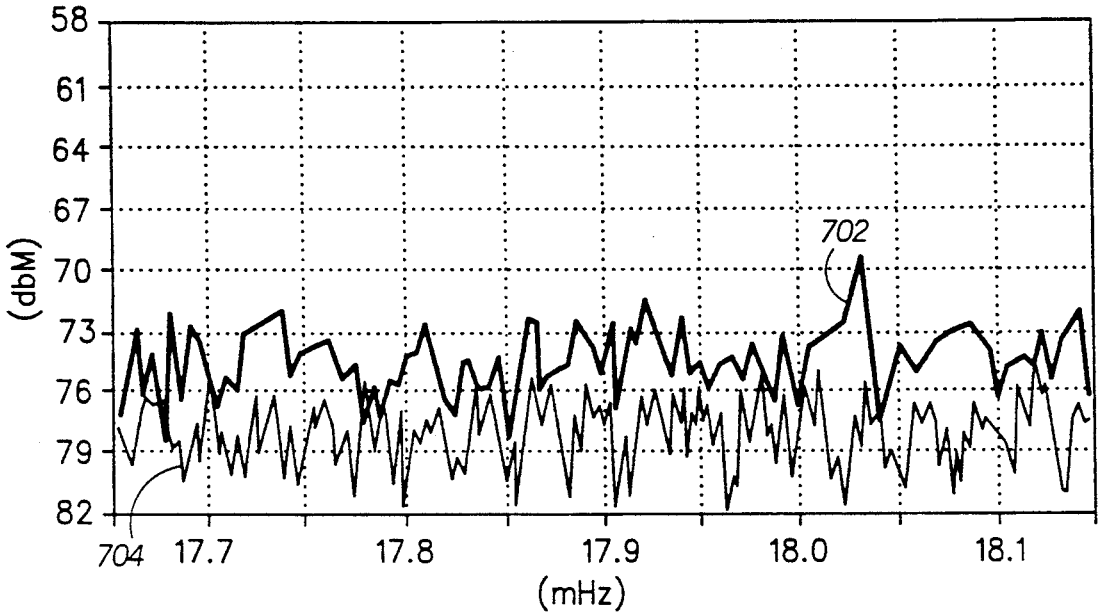
FIGS. 7 and 8 are graphs depicting a computer generated noise spectrum and improvement provided by the supplementary antenna in accordance with the preferred embodiment of the present invention.

FIG. 7 is a graph depicting the attenuation provided by the resonant wireform shield at the first IF frequency which, in the preferred embodiment of the present invention, is at 17.9 MHz. As shown, curve 702 represents the noise spectrum generated by the portable computer which is present at the 17.9 MHz IF input. Curve 704 represents the resultant noise level obtained with the resonant wireform shield is in place and represents an improvement of at least 3 to 5 dB.

Figure 8:
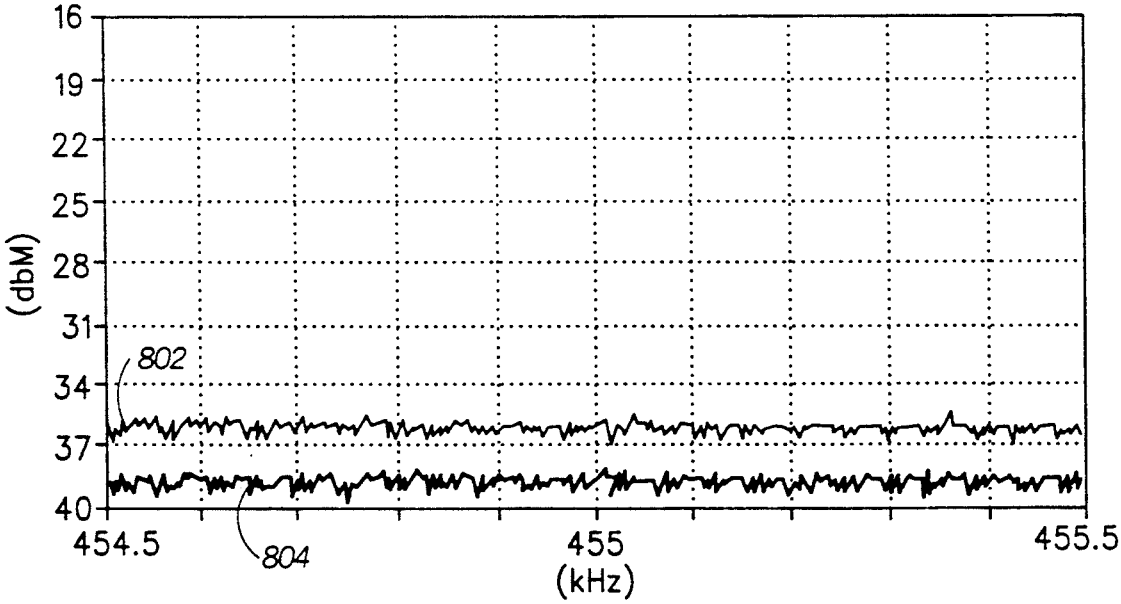

FIG. 8 is a graph depicting the attenuation provided by the resonant wireform shield at the second IF frequency which, in the preferred embodiment of the present invention, is at 455 KHz. As shown, curve 802 represents the noise spectrum generated by the portable computer which is present at the 455 KHz IF input. Curve 804 represents the resultant noise level obtained with the resonant wireform shield is in place and represents an improvement of at least 3 dB.

In summary, a supplementary antenna has been described which can be coupled to a communication receiver which is coupled to a portable computer. The supplementary antenna provides an increase in general receiver sensitivity, and in addition has provision to significantly attenuate interfering signals generated by the portable computer

We claim:

1. A supplementary antenna system for a communication receiver assigned to an operating frequency, and which has an internal antenna which is coupled to a portable computer to deliver received data messages thereto, said supplementary antenna system comprising:

a loop antenna, resonated at the receiver operating frequency and magnetically coupled to the internal antenna of the communication receiver; and a wireframe shield, resonated at a frequency different than the receiver operating frequency, and electrically coupled to, and physically oriented perpendicular to, said loop antenna, for shielding the communication receiver from an electrical interference signal generated by the portable computer.

2. The supplementary antenna system according to claim 1, wherein said loop antenna comprises:

a first rectangular conductive loop having a common side; and resonating means, coupled to said common side, for resonating said first rectangular conductive loop at the receiver operating frequency.

3. The supplementary antenna system according to claim 2 wherein said wireframe shield comprises:

a second conductive loop having a side formed contiguous from said common side of said first rectangular conductive loop and a shorting element coupled to and perpendicular to said common side and a side of said second conductive loop which is parallel to and opposed to said common side, wherein said resonating means resonates said second conductive loop at a frequency different than the receiver operating frequency to reject the electrical interference signal generated by the portable computer.

4. The supplementary antenna system according to claim 3 wherein said wireframe shield is rectangular.

5. The supplementary antenna system according to claim 3 wherein said shorting element is positioned to be magnetically coupled to the internal antenna.

6. An supplementary antenna system for a wireless computing system, comprising:

a communication receiver, having an internal antenna, for receiving transmitted data messages;

a portable computer, assigned to an operating frequency and coupled to said communication receiver, for receiving and processing the data messages received by said communication receiver;

a loop antenna, resonated at the receiver operating frequency and magnetically coupled to the internal antenna of the communication receiver; and a wireframe shield, resonated at a frequency different than the receiver operating frequency, and electrically coupled to, and physically oriented perpendicular to, said loop antenna, for shielding the communication receiver from an electrical interference signal generated by the portable computer.

7. The supplementary antenna system for a wireless computing system according to claim 6, wherein said loop antenna comprises:

a first rectangular conductive loop having a common side; and resonating means, coupled to said common side, for resonating said first rectangular conductive loop at the receiver operating frequency.

8. The supplementary antenna system for a wireless computing system according to claim 7 wherein said wireframe shield comprises:

a second conductive loop having a side formed contiguous from said common side of said first rectangular conductive loop; and a shorting element coupled to and perpendicular to said common side and a side of said second conductive loop which is parallel to and opposed to said common side, wherein said resonating means resonates said second conductive loop at a frequency different than the receiver operating frequency to reject the electrical interference signal generated by the portable computer.

9. The supplementary antenna system for a wireless computing system according to claim 8 wherein said wireframe shield is rectangular.

10. The supplementary antenna system according to claim 9 wherein said shorting element is positioned to be magnetically coupled to the internal antenna.

11. The supplementary antenna system according to claim 6 wherein said portable computer is a palmtop computer.

12. A supplementary antenna system for a wireless computing system, comprising:

a communication receiver assigned to an operating frequency, having an internal antenna mounted on a printed circuit board supporting a receiver circuit, said internal antenna having a major axis corresponding to a magnetic field of a transmitted electromagnetic wave, for receiving data messages transmitted on said electromagnetic wave;

a portable computer, coupled to said communication receiver, for receiving and processing the data messages received by said communication receiver;

a cradle for securing positionally said communication receiver and said portable computer;

a loop antenna, resonated at the receiver operating frequency and magnetically coupled to the internal antenna of the communication receiver; and a wireframe shield, resonated at frequency different than the receiver operating frequency, and electrically coupled to, and physically oriented perpendicular to, said loop antenna, for shielding the communication receiver from an electrical interference signal generated by the portable computer, and a housing for enclosing said loop antenna and said wireframe shield, said housing further for positioning said loop antenna in a plane perpendicular to said major axis of said internal antenna, and further for positioning said wireframe shield parallel to said printed circuit board.

13. The supplementary antenna system for a wireless computing system according to claim 12, wherein said loop antenna comprises:

a first rectangular conductive loop having a common side; and resonating means, coupled to said common side, for resonating said first rectangular conductive loop at the receiver operating frequency.

14. The supplementary antenna system for a wireless computing system according to claim 13 wherein said wireframe shield comprises:

a second conductive loop having a side formed contiguous from said common side of said first rectangular conductive loop; and a shorting element coupled to and perpendicular to said common side and a side of said second conductive loop which is parallel to and opposed to said common side, wherein said resonating means resonates said second conductive loop at a frequency different than the receiver operating frequency to reject the electrical interference signal generated by the portable computer.

15. The supplementary antenna system for a wireless computing system according to claim 14 wherein said wireframe shield is rectangular.

16. The supplementary antenna system for a wireless computing system according to claim 15 wherein said shorting element is positioned to be magnetically coupled to the internal antenna.

17. The supplementary antenna system for a wireless computing system according to claim 12, wherein said housing further comprises latching means for latching said supplementary antenna to said cradle.

18. The supplementary antenna system for a wireless computing system according to claim 17, wherein said cradle further comprises unlatching means for unlatching said supplementary antenna to enable removal from said cradle.

19. The supplementary antenna system according to claim 12 wherein said portable computer is a palmtop computer.

* * * * *

UNITED STATES PATENT AND TRADEMARK OFFICE

CERTIFICATE OF CORRECTION

PATENT NO. : 5,300,938
DATED : April 5, 1994
INVENTOR(S) : Maroun, et al.

It is certified that error appears in the above-indentified patent and that said Letters Patent is hereby corrected as shown below:

In claim 12, column 7, between lines 4 and 5, please insert:

--a supplementary antenna comprising--

Signed and Sealed this

Thirty-first Day of January, 1995

*Attest:*

Bruce Lehman

BRUCE LEHMAN

*Attesting Officer*

*Commissioner of Patents and Trademarks*